US010168012B1

(12) United States Patent
Raghavan et al.

(10) Patent No.: US 10,168,012 B1
(45) Date of Patent: Jan. 1, 2019

(54) MODULAR VAPOR-TIGHT LIGHT FIXTURE

(71) Applicant: MAXLITE, INC., West Caldwell, NJ (US)

(72) Inventors: Ramesh Raghavan, Edison, NJ (US); Jun Xiang, Parsippany, NJ (US)

(73) Assignee: MAXLITE, Inc., West Caldwell, NJ (US)

( * ) Notice: Subject to any disclaimer, the term of this patent is extended or adjusted under 35 U.S.C. 154(b) by 0 days.

(21) Appl. No.: 16/027,526

(22) Filed: Jul. 5, 2018

Related U.S. Application Data

(60) Provisional application No. 62/667,182, filed on May 4, 2018.

(51) Int. Cl.

| | |
|---|---|
| ***F21S 8/06*** | (2006.01) |
| ***F21V 31/00*** | (2006.01) |
| ***F21S 8/04*** | (2006.01) |
| *F21Y 103/00* | (2016.01) |

(52) U.S. Cl.
CPC ..... *F21S 8/06* (2013.01); *F21S 8/046* (2013.01); *F21V 31/005* (2013.01); *F21Y 2103/00* (2013.01)

(58) Field of Classification Search
CPC ..... F21S 8/06; F21S 8/046; F21V 31/005; F21Y 2103/00; F21W 2131/10
See application file for complete search history.

(56) References Cited

U.S. PATENT DOCUMENTS

| | | | | |
|---|---|---|---|---|
| 3,328,578 | A * | 6/1967 | Gough | F21V 31/005 362/217.08 |
| 8,888,315 | B2 * | 11/2014 | Edwards | F21V 31/005 362/223 |
| 9,423,116 | B2 * | 8/2016 | Sieberth | F21V 23/06 |
| 2017/0268756 | A1 | 9/2017 | Chami et al. | |

* cited by examiner

*Primary Examiner* — Diane I Lee
*Assistant Examiner* — Naomi M Wolford
(74) *Attorney, Agent, or Firm* — Budzyn IP Law, LLC

(57) ABSTRACT

A modular vapor-tight light fixture is provided herein which generally includes first and second vapor-tight light modules, and a coupling for connecting the first and second vapor-tight light modules. Each of the vapor-tight light modules includes: a channel housing; a lens secured to the channel housing; a plurality of solid state light generating elements; and, first and second end caps. Each of the channel housings includes first and second rails which each define a mounting channel. The coupling includes mounting strip portions configured such that, with the first and second vapor-tight light modules being adjacent, the mounting strip portions are simultaneously received in the mounting channels of both the first and second vapor-tight light modules. Advantageously, with the subject invention, fully enclosed vapor-tight light modules may be provided at shorter lengths which are connected by the coupling to provide a fixture comparable in length to prior-art vapor-tight light fixtures.

24 Claims, 12 Drawing Sheets

SCALE 0,180

SCALE 1,000

SCALE 1,500

SCALE 1,500

MODULAR VAPOR-TIGHT LIGHT FIXTURE

CROSS-REFERENCE TO RELATED APPLICATION

This application claims priority to U.S. Provisional Patent Application No. 62/667,182 filed May 4, 2018, the contents of which are incorporated by reference herein.

BACKGROUND OF THE INVENTION

Solid state vapor-lighting fixtures are known in the prior art, such as that shown in U.S. Pat. No. 8,888,315 to Edwards et al. Because of the vapor-tightness, these fixtures are generally weatherproof and are used in various indoor, outdoor, and indoor/outdoor environments, being provided with sealed lenses which resist the ingress of moisture, vapor and other contaminants into the fixture. Vapor-tight light fixtures are well-suited for vandal-resistant, dust, wet, and/or spray-down locations, such as parking garages, tunnels, temporary construction lighting, food processing and walk-in freezers, under awnings, car washes and wash bays, farms and barns, subways, laundry facilities, and sports arenas.

As with other lighting applications, vapor-tight lighting fixtures have been provided with light emitting diodes (LED) type light generating elements. In addition, due to the relative large size of the areas being lit, relatively long lighting fixtures, such as 8 feet in length, have been utilized. The shipping of such relatively long lighting fixtures presents difficulties.

SUMMARY OF THE INVENTION

A modular vapor-tight light fixture is provided herein which generally includes a first vapor-tight light module, a second vapor-tight light module, and a coupling for connecting the first and second vapor-tight light modules. Each of the vapor-tight light modules includes: a channel housing; a lens secured to the channel housing; a plurality of solid state light generating elements arranged between the lens and the channel housing; and, first and second end caps secured to ends of the channel housing. Further, each of the channel housings includes first and second rails which each define a mounting channel. The coupling includes mounting strip portions configured such that, with the first and second vapor-tight light modules being adjacent, mounting strip portions are simultaneously received in the mounting channels of both the first and second vapor-tight light modules. Advantageously, with the subject invention, fully enclosed vapor-tight light modules may be provided at shorter lengths which are connected by the coupling to provide a fixture comparable in length to prior-art vapor-tight light fixtures.

As used herein, "vapor-tight" is used as in the art, to signify a generally weatherproof light fixture which includes all seals to resist the ingress of moisture, vapor, dust, and contaminants. The specific details of achieving vapor-tightness are fully not discussed herein, as these are known in the art.

These and other features of the invention shall be better understood through a study of the following detailed description and accompanying drawings.

DETAILED DESCRIPTION OF THE INVENTION

As shown in the Figures, a modular vapor-tight light fixture 10 is provided. The light fixture 10 is composed of at least two vapor-tight light modules 12. The light modules 12 are each formed in similar fashion. For illustrative purposes, the use of two of the light modules 12 (12A, 12B) is discussed herein. As will be readily understood by those skilled in the art, the light fixture 10 may be composed of more than two of the light modules 12. A coupling 14 is provided to connect each pair of adjacent light modules 12.

Figure 3:
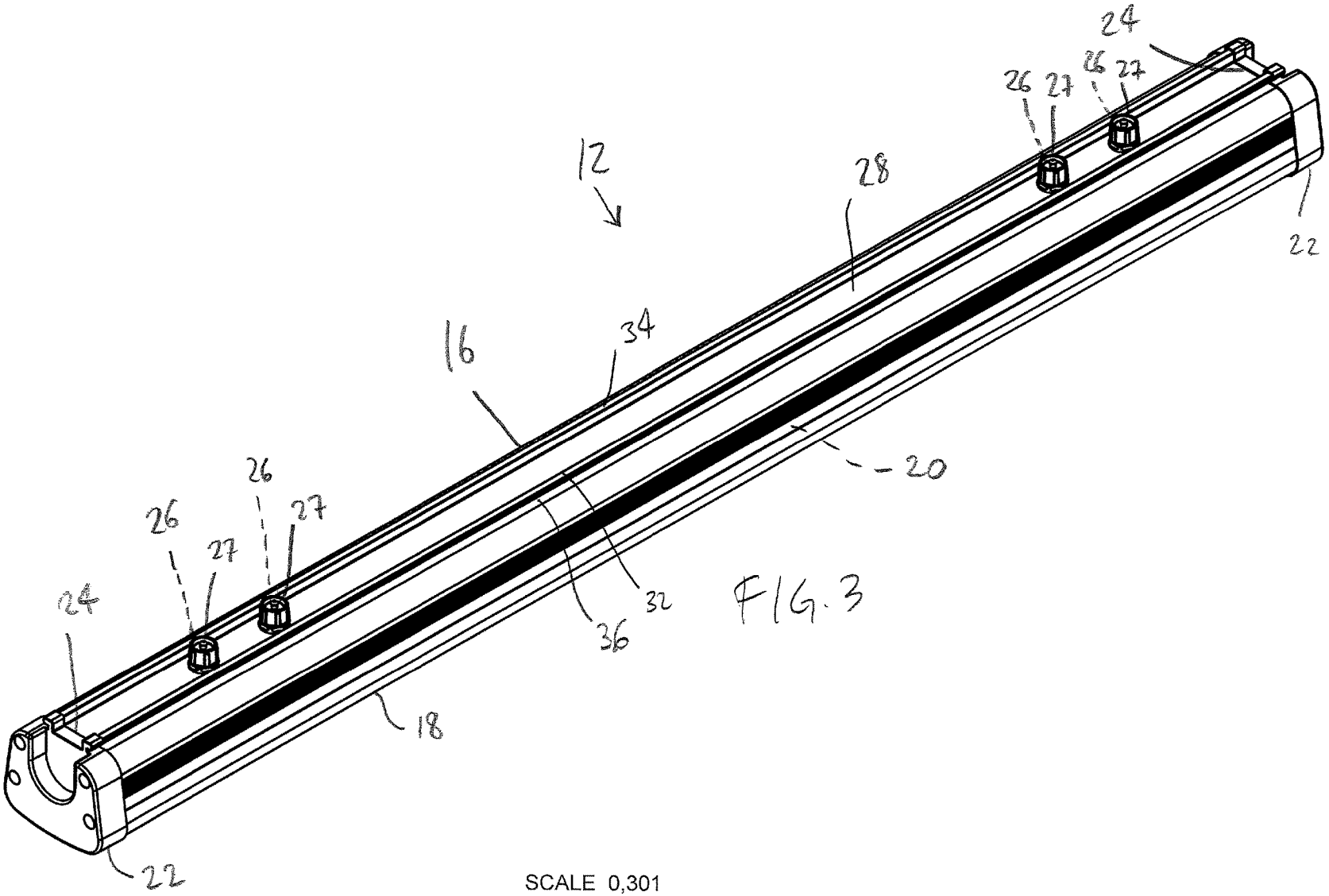
FIGS. 3-5 depict a light module useable with the subject invention.
Figure 4:
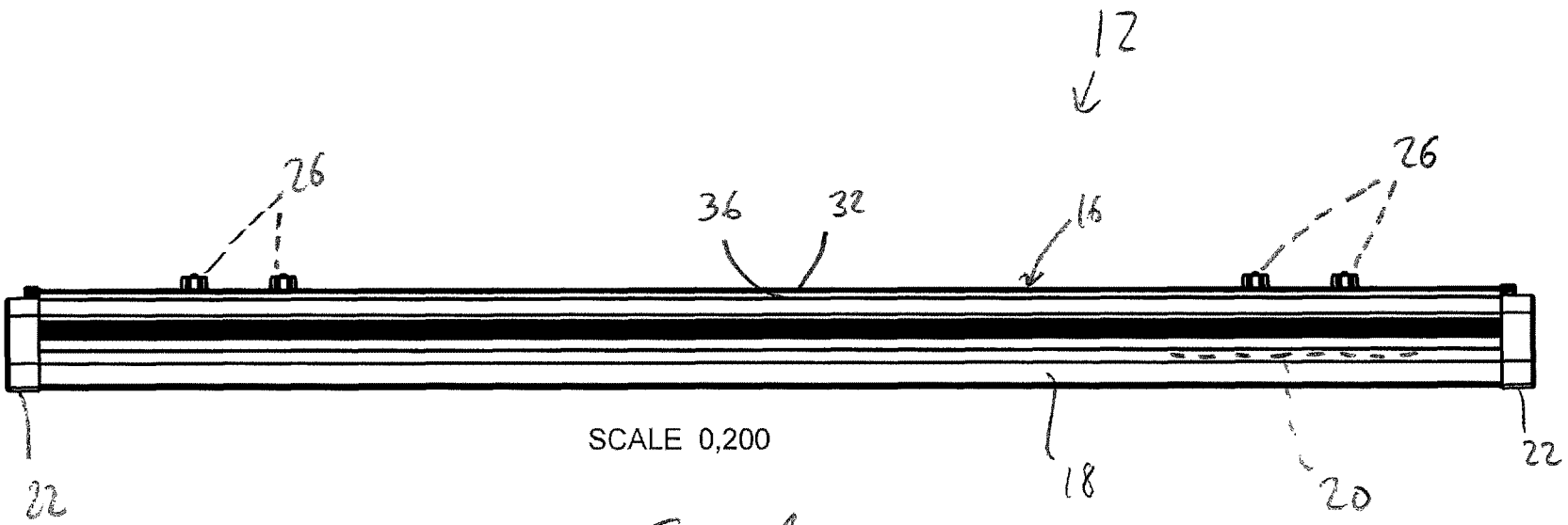
Figure 5:
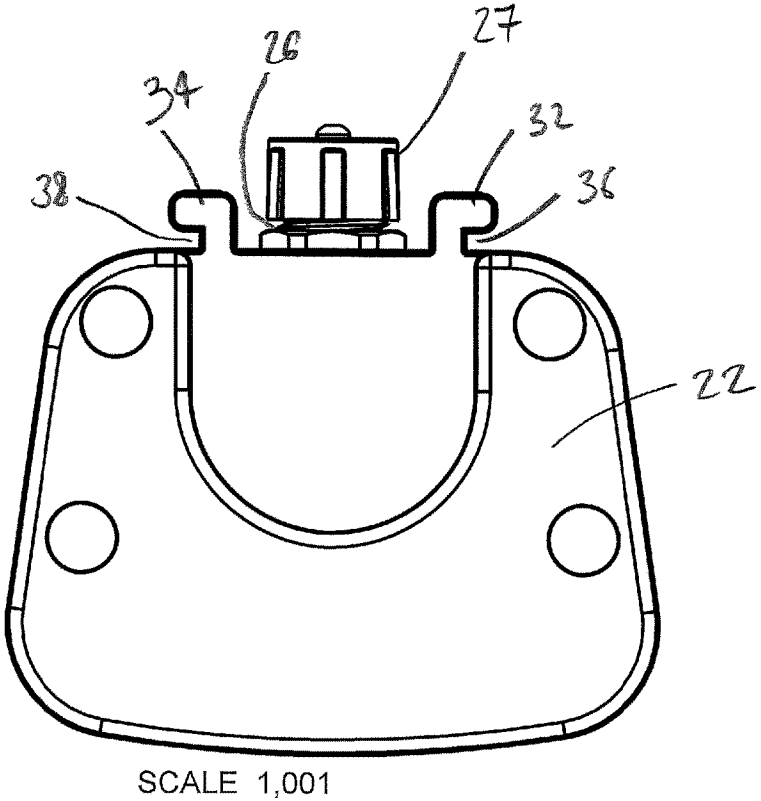

With reference to FIGS. 3-5, each of the light modules 12 is a stand-alone light fixture. Each of the light modules 12 includes a channel housing 16 with a lens 18 secured thereto. In a preferred embodiment, the light modules 12 are provided as installation-ready, where the lens 18 does not have to be removed from the channel housing 16 to perform any internal wiring. With this arrangement, the lens 18 may be secured to the channel housing 16 to define a vapor-tight interface therebetween.

A plurality of solid state light generating elements 20 are arranged between the channel housing 16 and the lens 18. The light generating elements 20 may of any form of solid state lighting, including, but not limited to, light emitting diodes (LEDs), organic light emitting diodes (OLEDs), and/or, polymeric light emitting diodes (PLEDs). All circuitry, driver(s), and wiring required to illuminate the light generating elements 20 are provided for within the channel housing 16 and/or the lens 18. The light generating elements 20 may be mounted to a board, which is in turn secured to the channel housing 16. The circuitry, driver(s), and wiring may be mounted to the board and/or the channel housing 16.

To fully enclose each of the light modules 12, an end cap 22 is secured to each end 24 of the channel housing 16. Preferably, the interface between the end caps 22 and the channel housing 16 and the lens 18 are sealed to be vapor-tight. Collectively, the channel housing 16, the lens 18, and the end caps 22 restrict the ingress of vapor into the light module 12.

The lens 18 may be formed of thermoplastic material and may be provided as clear or translucent. Likewise, the end caps 22 may be formed of thermoplastic material and may be provided as clear or translucent. It is preferred that the channel housing 16 be metallic for strength and thermal conductivity. The channel housing 16 must be sufficiently robust to support the weight of the light module 12 in suspension at its ends without excessively bowing in the middle.

Figure 1:
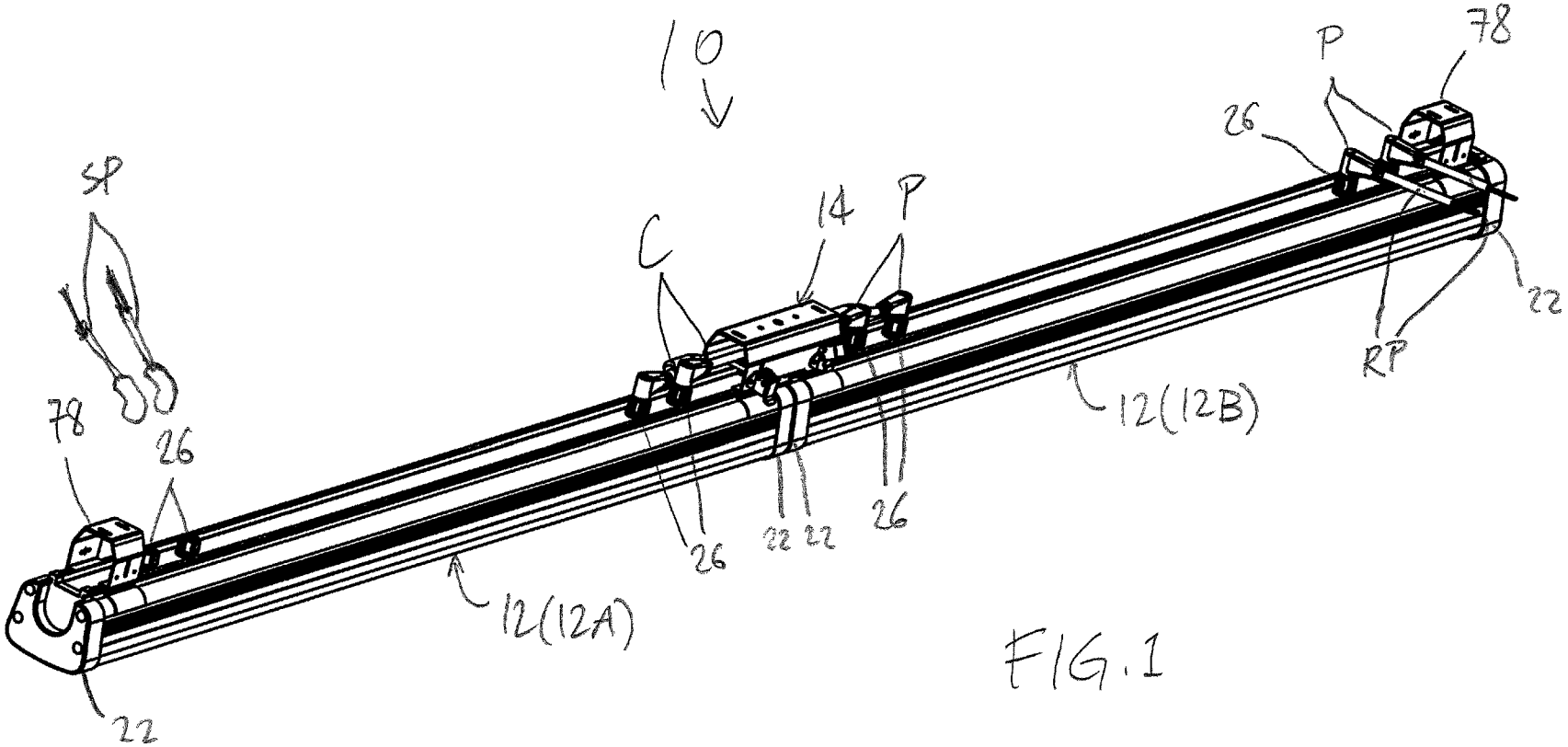
FIGS. 1 and 2 depict a modular vapor-tight light fixture in accordance with the subject invention.
Figure 2:
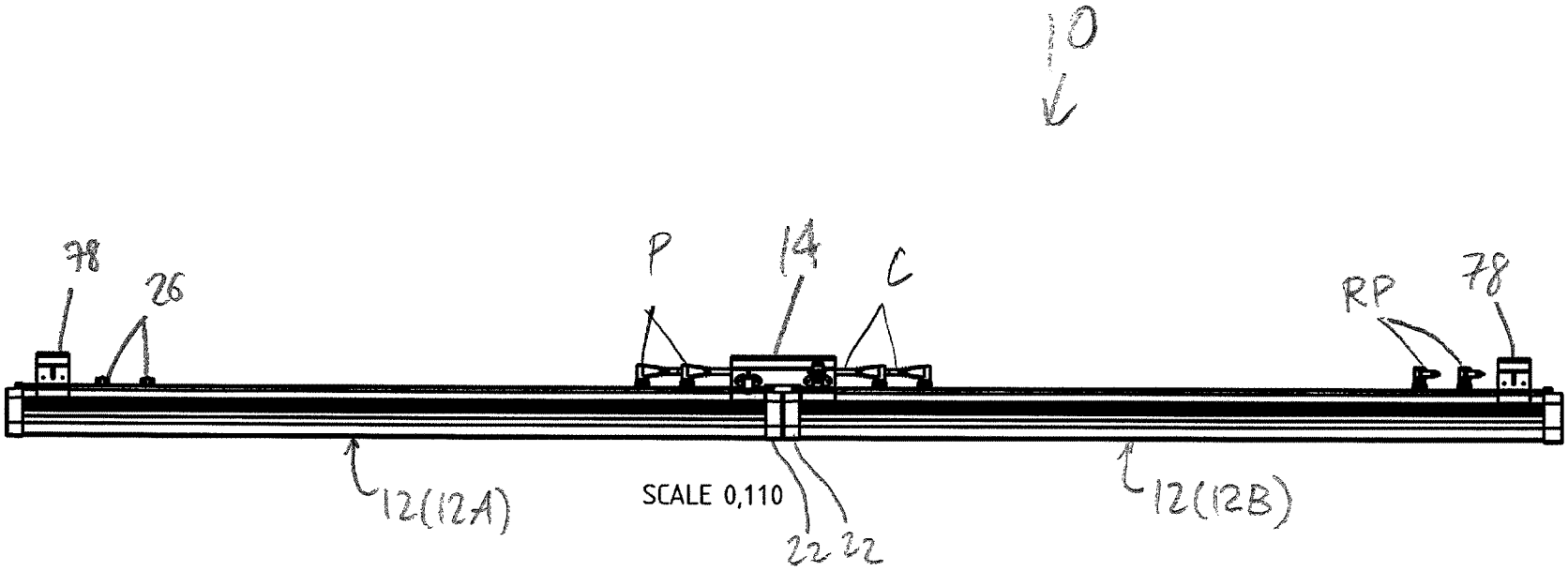

The light module 12 must be connected to an external power source. In addition, with a series of light modules 12, power may be transferred in series from one light module to the next. With reference to FIG. 1, supply power wires SP may be connected to the first light module 12A, with connecting wires C carrying power from the first light module 12A to the second light module 12B, with further return power wires RP being connected to the second light module 12B. In this manner, one supply of power is useable for the entirety of the light fixture 10. With the use of additional light modules 12, power may be further conveyed in series.

To best provide vapor-tightness for the light module 12, vapor-tight connections are desired with any connected wires. To this end, the channel housing 16 may be provided with a plurality of wire ports 26. Preferably, the wire ports 26 are located on a back panel 28 of the channel housing 16, opposite the lens 18. In this manner, all wiring is provided to the rear of the light fixture 10 providing an uncluttered appearance, particularly in being suspension-mounted. With the light modules 12 being provided as installation-ready, each of the wire ports 26 is provided with an electrical power jack 30 secured to be vapor-tight in the corresponding wire port 26. Correspondingly, each of the supply power wires SP, the connecting wires C, and the return power wires RP is provided with a plug P adapted to plug into the corresponding electrical power jack 30. The electrical power jacks 30 and the plugs P are configured to provide a vapor-tight connection therebetween. As shown in FIGS. 3-5, the wire ports 26 may be covered with removable caps 27 for storage and transportation.

It is preferred that a pair of the wire ports 26 be located adjacent to each of the ends 24 of the channel housing 16. This allows for power to be accessed at the ends of the light module 12 both externally and by an adjacent of the light modules 12.

To facilitate connection between the light modules 12, the channel housing 16 includes first and second rails 32, 34 which define respectively first and second mounting channels 36, 38. As best shown in FIG. 5, the first and second rails 32, 34 preferably extend from the back panel 28 with the first and second mounting channels 36, 38 being defined between the respective first and second rails 32, 34 and the back panel 28. The first and second rails 32, 34 may be L-shaped and directed to face in opposing directions. The first and second rails 32, 34 may extend continuously along the channel housing 16 between the ends 24. The wire ports 26 may be located between the first and second rails 32, 34.

The coupling 14 includes a body 39 having first, second, third, and fourth mounting strip portions 40, 42, 44, 46 configured to be received simultaneously in the first and second mounting channels 36, 38 of two of the light modules 12. The body may have a generally inverted U-shape with a top 48 and first and second sides 50, 52 extending downwardly therefrom. The first and third mounting strip portions 40, 44 may extend inwardly from the first side 50 with the second and fourth mounting strip portions 42, 46 extending inwardly from the second side 52. The first and third mounting strip portions 40, 44 may be formed spaced-apart along the first side 50, or, be connected so as to be formed continuously along the first side 50. Likewise, the second and fourth mounting strip portions 42, 46 may be formed spaced-apart along the second side 52, or, be connected so as to be formed continuously along the second side 52. Preferably, the first and second mounting strip portions 40, 42 are aligned to be facing each other, and the third and fourth mounting strip portions 44, 46 are aligned to be facing each other.

To couple together the first light module 12A and the second light module 12B to form the light fixture 10, one of the end caps 22 of the first light module 12A is placed adjacent to one of the end caps 22 of the second light module 12B, particularly with the first and second light modules 12A, 12B being aligned along a common longitudinal axis. The coupling 14 is mounted to both the first and second light modules 12A, 12B with the first and second mounting strip portions 40, 42 being simultaneously received respectively in the first and second mounting channels 38, 38 of the first light module 12A with the third and fourth mounting strip portions 44, 46 being simultaneously received respectively in the first and second mounting channels 36, 38 of the second light module 12B. In this manner, multiple and simultaneous points of contact are made which provide connection between the first and second light modules 12A, 12B.

Also, it is preferred that the coupling 14 be sufficiently sized to allow passage therethrough of the connecting wires C with the coupling 14 being connected to the light modules 12A, 12B.

To maintain connection, the mounting strip portions 40, 42, 44, 46 may be formed to be frictionally and/or interferingly received in the respective mounting channels 36, 38.

To enhance the connection, at least one releasable lock 54 may be provided with the coupling 14 to be selectively adjustable between a first state where compressive force is applied so as to draw the first and second sides 50, 52 closer, and a second state where the compressive force is not applied. With the compressive force, force is applied to urge the mounting strip portions 40, 42, 44, 46 inwardly to enhance their connection. The releasable lock 54 may be of any known configuration which allows for compressive force to be applied to the first and second sides 50, 52 of the coupling 14.

By way of non-limiting example, the releasable lock 54 may be provided with a locking bar 56 having a notch 58, and a handle 60 fixed to the locking bar 56. A first slit 62 is formed in the first side 50 of the coupling 14 with the locking bar 56 extending therethrough with the first side 50 being seated in the notch 58. A second slit 64 is formed in the second side 52 of the coupling 14 with the locking bar 56 extending therethrough. The handle 60 is pivotally mounted to the second side 52 of the coupling 14, preferably on an outer face 66 thereof. The handle 60 is pivotally mounted to displace the locking bar 56 between (i) the first state where the first side 50 is seated in the notch 58 with the locking bar 56 pressing inwardly against the first side 50 so as to fix the locking bar 56 to the first side 50, and (ii) the second state where the first side 50 is seated in the notch 58 but without the locking bar 56 pressing inwardly against the first side 50. It is preferred that the first and second sides 50, 52 be resilient to not deform (inelastically) under the force of compression. In this manner, the first and second sides 50, 52 may accept the compressive force without significant loss thereof.

Figure 8:
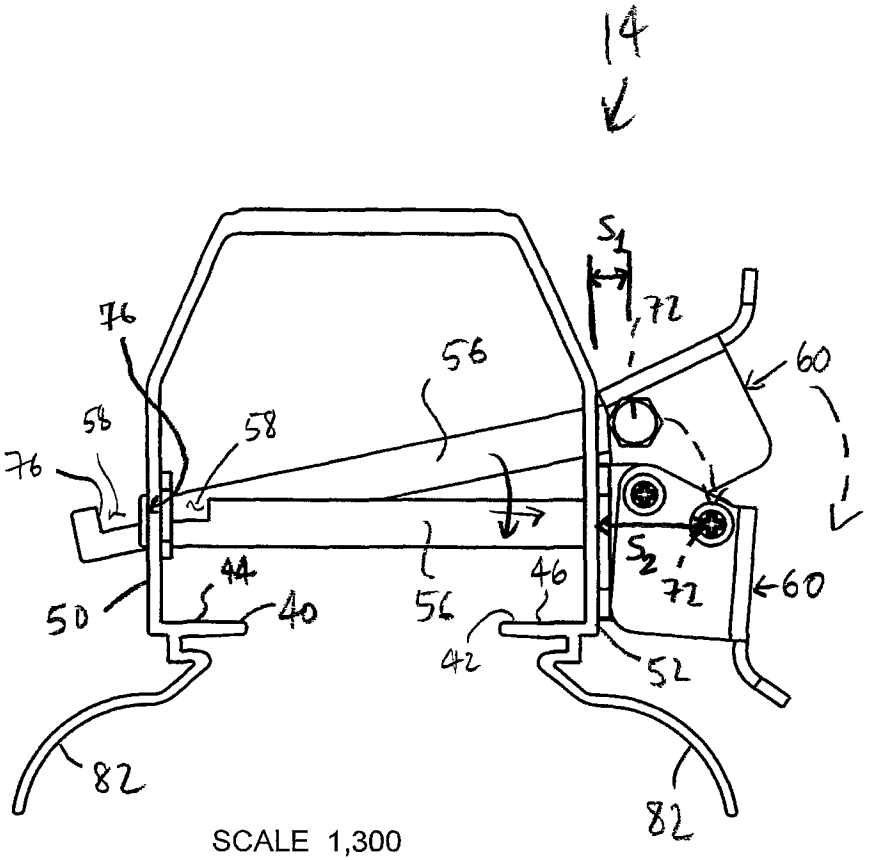

The handle 60 may be formed yoke shaped with side panels 68 pivotally mounted to a bracket 70 mounted on the outer face 66 of the second side 52. A cross-piece 72 may be provided to extend across the interior of the handle 60 to which the locking bar 56 is fixed. This connection may be defined by a mounting ring 74 formed at an end of the locking bar 56 through which the cross-piece 72 extends. As shown in FIG. 8, the handle 60 is pivotable from an up position (the second state with no compressive force) to a down position (the first state with compressive force). In traversing from the second state to the first state, the locking bar 56 is simultaneously angularly displaced downwardly and extended outwardly through the second slit 64. In the second state, the first side 50 is clear of outer edge 76 of the notch 58. In the first state, the outer edge 76 is pulled into contact with the first side 50 to create a compressive inward force between the first and second sides 50, 52.

As shown in FIG. 8, the pivoting of the handle 60 from the up position to the down position causes the cross-piece 72 to be located further away from the second side 52 of the coupling 14. In particular, with the handle 60 in the up position, the cross-piece 72 is located a distance $S_1$ from the second side 52. In the down position, the cross-piece 72 is located a distance $S_2$ which is greater than $S_1$. With the locking bar 56 fixed to the cross-piece 72, the locking bar 56 is caused to extend outwardly through the second side 52, in particular through the second slit 64, with the handle 60 being moved from the up to the down position. With the locking bar 56 fixed to the first side 50, the outward movement of the locking bar 56 causes the locking bar 56 to draw the first side 50 towards the second side 52.

The handle 60 may be configured to frictionally and/or interferingly engage the bracket 70 in the down position (i.e., the first state). This allows for the handle 60 to be retained with compressive force being maintained. This compressive force, as discussed above, enhances the connection between the coupling 14 and the first and second light modules 12A, 12B.

Figure 6:
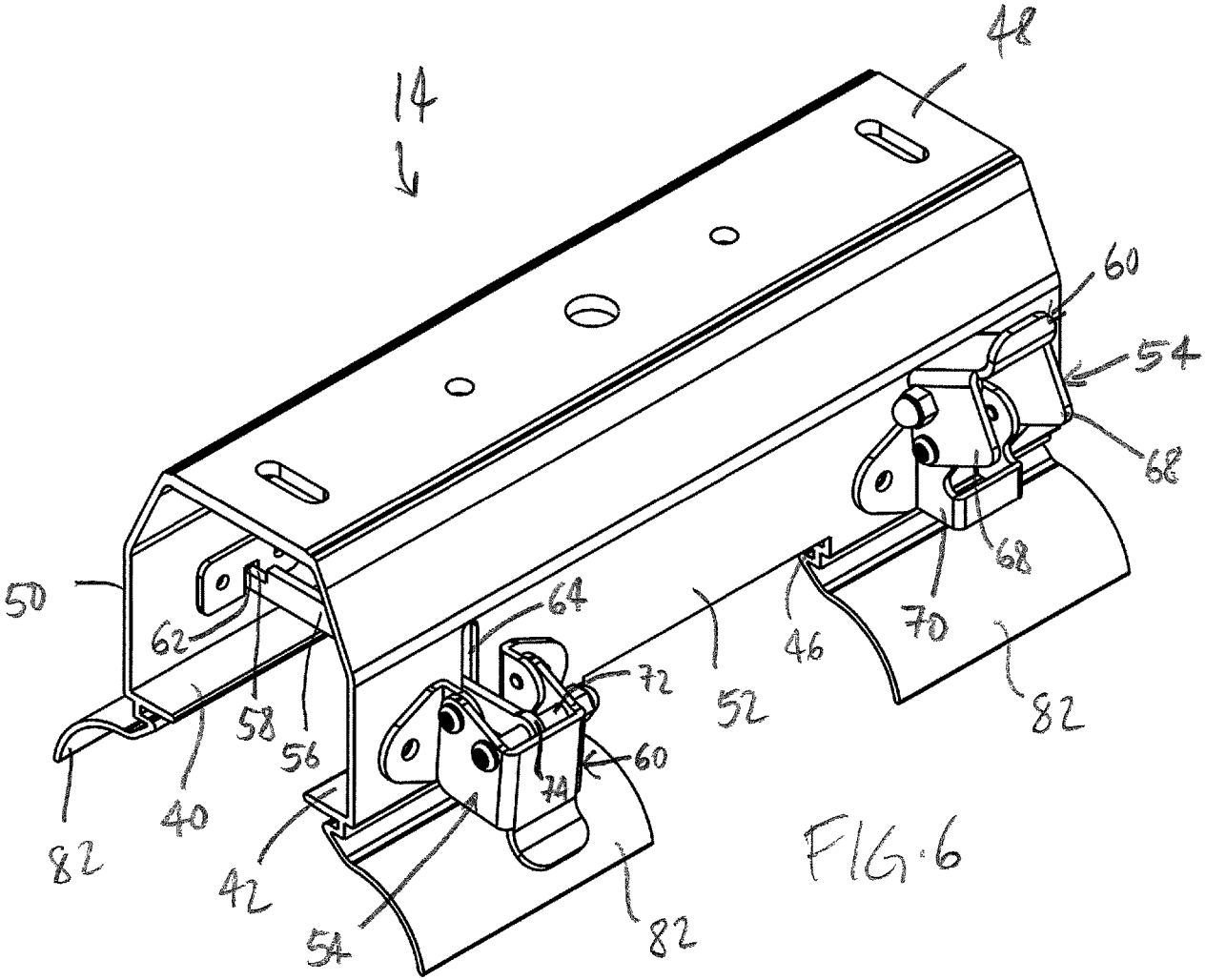
FIGS. 6-8 depict a coupling useable with the subject invention.
Figure 7:
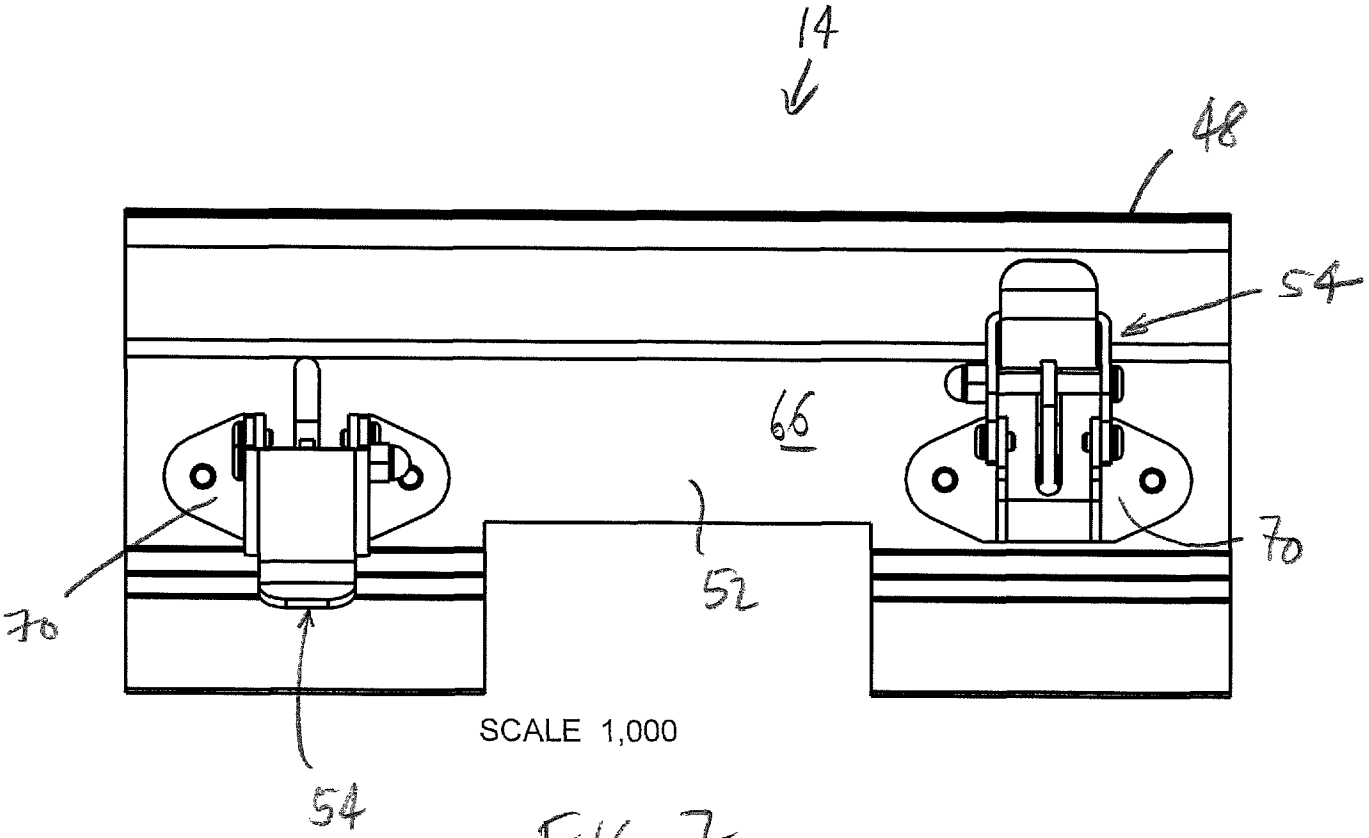

As seen in FIGS. 6-8, the coupling 14 may be provided with two of the releasable locks 54. In addition, it is preferred that the releasable locks 54 be positioned so that the locking bar 56 of each of the releasable locks 54 is transversely aligned with one pair of the facing mounting strip portions 40, 42 and 44, 46 (i.e., the locking bar 56 is located to span the body 39 in alignment with a pair of facing mounting strip portions).

Figure 9:
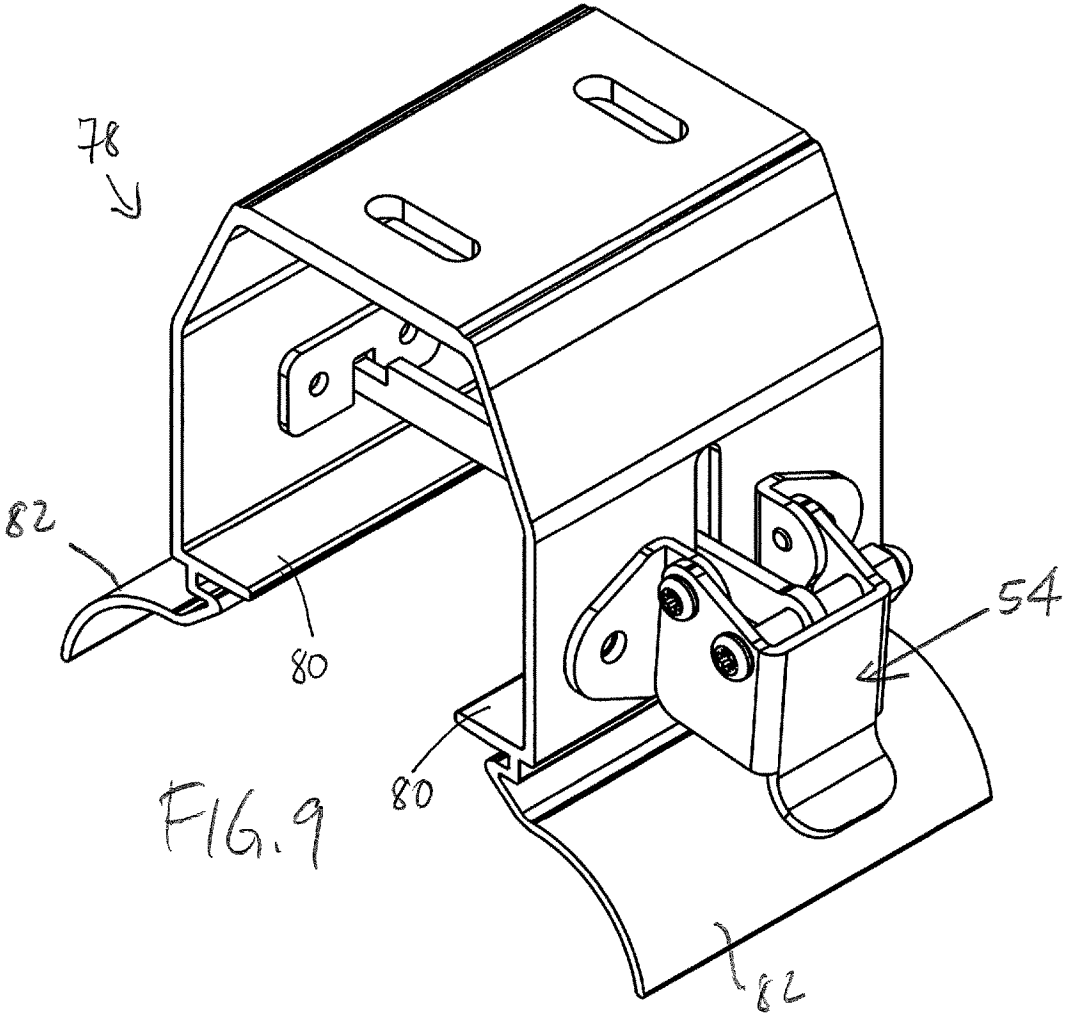
FIGS. 9-11 depict a mounting bracket useable with the subject invention; and, FIG. 12 depicts an end view of a vapor-tight light fixture in accordance with the subject invention.
Figure 10:
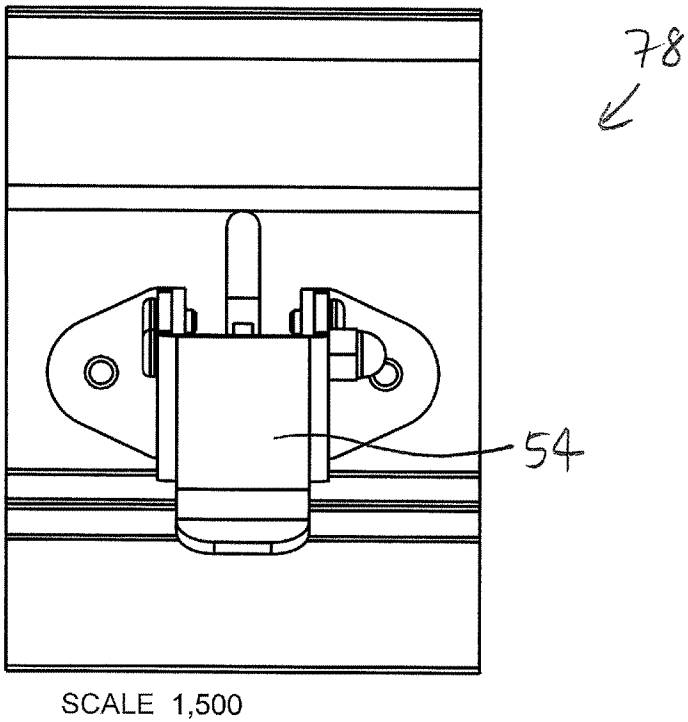
Figure 11:
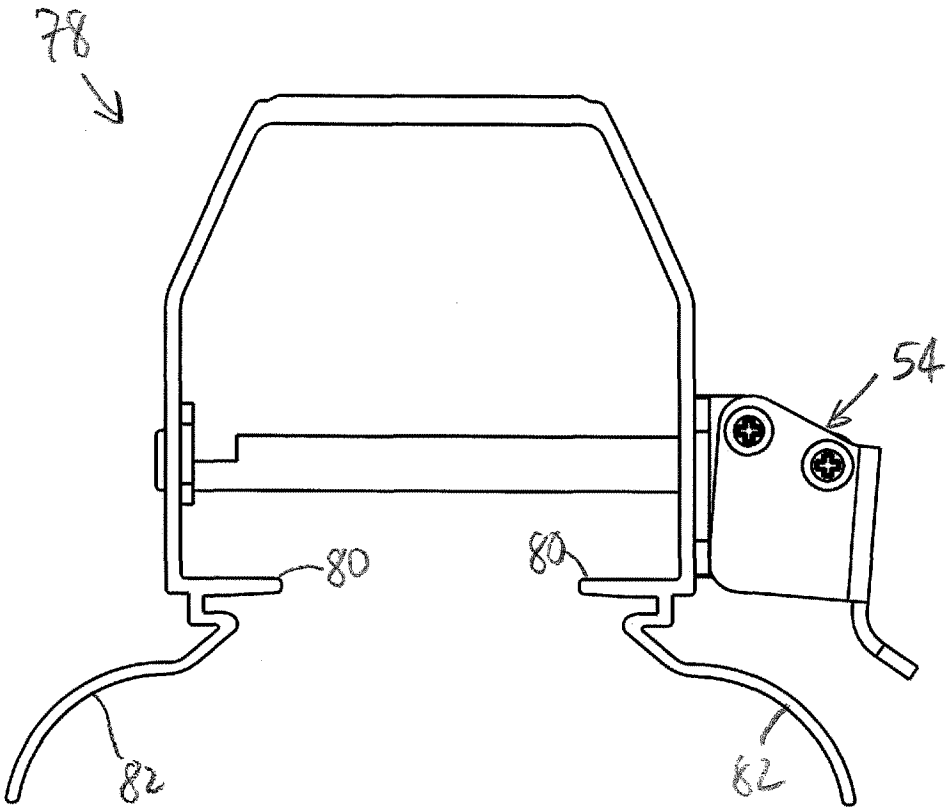
Figure 12:
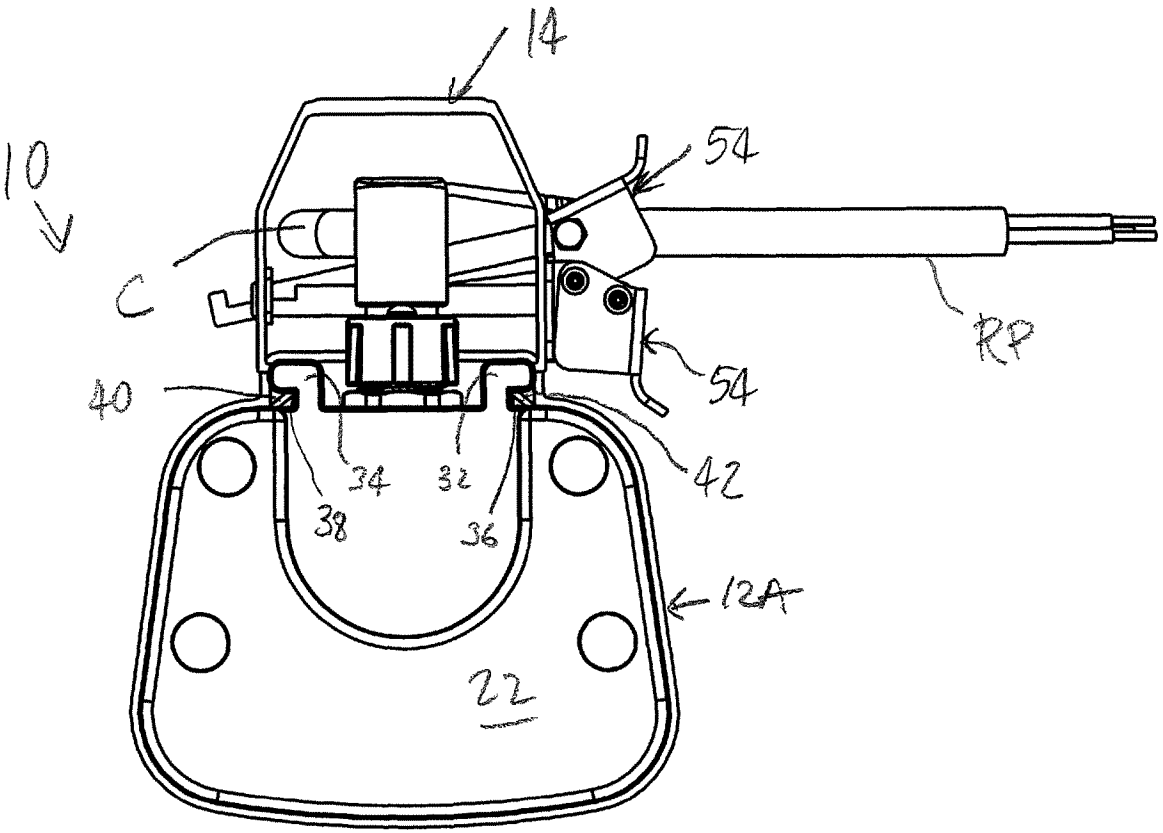

The light fixture 10 may further include one or more mounting brackets 78. As shown in FIGS. 9-11, the mounting brackets 78 are equivalent to a truncated (e.g., half size) of the coupling 14. One pair of opposing secondary mounting strip portions 80 are provided to be received in the first and second mounting channels 36, 38 in the same manner as described above. Here, however, the mounting bracket 78 is secured to only one of the lighting modules 12. This allows for a mounting or suspension surface, equivalent to the height of the coupling 14, to be provided at a spaced location from the coupling 14 for proper weight distribution. The mounting brackets 78 may be provided on each of the first and second light modules 12A, 12B spaced from the coupling 14. The mounting brackets 78 may be each provided with at least one of the releasable locks 54, as described above.

The coupling 14 and/or the mounting brackets 78 may be provided with one or more feet 82 contoured to the profile of the channel housing 16 for pressing engagement therewith. This provides for additional stability between the components.

With the subject invention, the light fixture 10 may be shipped in parts, including the first light module 12A, the second light module 12B, and the coupling 14. The coupling 14 may be connected without the use of tools. Furthermore, power and other electrical connections may be made without the use of tools (plug/jack connections). In addition, the mounting brackets 78 may be connected to the first light module 12A and/or the second light module 12B as needed, also without tools. With the ability to connect the light modules, the length of individual light modules may be minimized. This saves on storage and shipping costs. Ease of assembly provides for time savings. Furthermore, the light fixture 12 is scalable to allow for various numbers of the light modules to be provided in series. Any additional units are connected in the manner as discussed above.

What is claimed is:

1. A modular vapor-tight light fixture comprising:

a first vapor-tight light module having:

a first channel housing;

a first lens secured to said first channel housing;

a first plurality of solid state light generating elements arranged between said first lens and said first channel housing;

a first end cap secured to a first end of said first channel housing; and, a second end cap secured to a second end of said first channel housing, wherein, said first channel housing including first and second rails which define respectively first and second mounting channels;

a second vapor-tight light module having:

a second channel housing;

a second lens secured to said second channel housing;

a second plurality of solid state light generating elements arranged between said second lens and said second channel housing;

a third end cap secured to a first end of said second channel housing; and, a fourth end cap secured to a second end of said second channel housing, wherein, said second channel housing including third and fourth rails which define respectively third and fourth mounting channels; and, a coupling for connecting said first and second vapor-tight light modules, said coupling having first, second, third, and fourth mounting strip portions configured such that, with said first end cap of said first vapor-tight light module being adjacent to said third end cap of said second vapor-tight light module, said first and second mounting strip portions are simultaneously received respectively in said first and second mounting channels with said third and fourth mounting strip portions being simultaneously received respectively in said third and fourth mounting channels, wherein said coupling having a generally inverted U-shape with first and second sides, said first and third mounting strip portions extending inwardly from said first side, said second and fourth mounting strip portions extending inwardly from said second side, wherein said coupling includes at least one releasable lock selectively adjustable between a first state where a compressive force is applied so as to draw said first and second sides closer, and a second state where said compressive force is not applied, and, wherein said at least one releasable lock includes a locking bar and a handle fixed to said locking bar, a slit being formed in said second side of said coupling with said locking bar extending therethrough, said handle being pivotally mounted to said second side to displace said locking bar such that said locking bar is extendable through said slit.

2. The modular vapor-tight light fixture as in claim 1, wherein said first and third mounting strip portions are formed continuously, and said second and fourth mounting strip portions are formed continuously.

3. The modular vapor-tight light fixture as in claim 1, wherein said first rail is L-shaped, and said second rail is L-shaped, with said first and second rails facing in opposing directions.

4. The modular vapor-tight light fixture as in claim 1, wherein at least one first connection wiring port is defined in said first channel housing in proximity to said first end, and at least one second connection wiring port is defined in said second channel housing in proximity to said third end, and, wherein, said generally inverted U-shape of said coupling being configured to allow wiring to extend therethrough between said at least one first connection wiring port and said at least one second connection wiring port.

5. The modular vapor-tight light fixture as in claim 1, wherein said locking bar of a first of said at least one releasable lock is transversely aligned with said first and second mounting strip portions.

6. The modular vapor-tight light fixture as in claim 5, wherein said locking bar of a second of said at least one releasable lock is transversely aligned with said third and fourth mounting strip portions.

7. The modular vapor-tight light fixture as in claim 1, wherein said handle is frictionally retainable with said at least one releasable lock being in said first state.

8. The modular vapor-tight light fixture as in claim 7, wherein said at least one releasable lock includes a bracket, said handle frictionally engaging said bracket to be releasably retained with said at least one releasable lock being in said first state.

9. The modular vapor-tight light fixture as in claim 1, wherein said at least one releasable lock includes a bracket, said handle interferingly engaging said bracket to be releasably retained with said at least one releasable lock being in said first state.

10. The modular vapor-tight light fixture as in claim 1, wherein said first and third end caps are translucent.

11. The modular vapor-tight light fixture as in claim 1, further comprising at least one mounting bracket having first and second secondary mounting strip portions configured to be simultaneously received respectively in said first and second mounting channels.

12. The modular vapor-tight light fixture as in claim 1, wherein said first and second rails extend continuously between said first and second ends of said first channel housing.

13. A modular vapor-tight light fixture comprising:

a first vapor-tight light module having:

a first channel housing;

a first lens secured to said first channel housing;

a first plurality of solid state light generating elements arranged between said first lens and said first channel housing;

a first end cap secured to a first end of said first channel housing; and, a second end cap secured to a second end of said first channel housing, wherein, said first channel housing including first and second rails which define respectively first and second mounting channels;

a second vapor-tight light module having:

a second channel housing;

a second lens secured to said second channel housing;

a second plurality of solid state light generating elements arranged between said second lens and said second channel housing;

a third end cap secured to a first end of said second channel housing; and, a fourth end cap secured to a second end of said second channel housing, wherein, said second channel housing including third and fourth rails which define respectively third and fourth mounting channels; and, a coupling for connecting said first and second vapor-tight light modules, said coupling having first, second, third, and fourth mounting strip portions configured such that, with said first end cap of said first vapor-tight light module being adjacent to said third end cap of said second vapor-tight light module, said first and second mounting strip portions are simultaneously received respectively in said first and second mounting channels with said third and fourth mounting strip portions being simultaneously received respectively in said third and fourth mounting channels, wherein said coupling having a generally inverted U-shape with first and second sides, said first and third mounting strip portions extending inwardly from said first side, said second and fourth mounting strip portions extending inwardly from said second side, wherein said coupling includes at least one releasable lock selectively adjustable between a first state where a compressive force is applied so as to draw said first and second sides closer, and a second state where said compressive force is not applied, and, wherein said at least one releasable lock includes a locking bar having a notch and a handle fixed to said locking bar, a first slit being formed in said first side of said coupling with said locking bar extending therethrough with said first side being seated in said notch of said locking bar, a second slit being formed in said second side of said coupling with said locking bar extending therethrough, said handle being pivotally mounted to said second side to displace said locking bar such that (i) in the first state said first side being seated in said notch with said locking bar pressing inwardly against the first side, and (ii) in the second state said first side being seated in said notch with said locking bar not pressing inwardly against the first side.

14. The modular vapor-tight light fixture as in claim 13, wherein said first and third mounting strip portions are formed continuously, and said second and fourth mounting strip portions are formed continuously.

15. The modular vapor-tight light fixture as in claim 13, wherein said first rail is L-shaped, and said second rail is L-shaped, with said first and second rails facing in opposing directions.

16. The modular vapor-tight light fixture as in claim 13, wherein at least one first connection wiring port is defined in said first channel housing in proximity to said first end, and at least one second connection wiring port is defined in said second channel housing in proximity to said third end, and, wherein, said generally inverted U-shape of said coupling being configured to allow wiring to extend therethrough between said at least one first connection wiring port and said at least one second connection wiring port.

17. The modular vapor-tight light fixture as in claim 13, wherein said locking bar of a first of said at least one releasable lock is transversely aligned with said first and second mounting strip portions.

18. The modular vapor-tight light fixture as in claim 17, wherein said locking bar of a second of said at least one releasable lock is transversely aligned with said third and fourth mounting strip portions.

19. The modular vapor-tight light fixture as in claim 13, wherein said handle is frictionally retainable with said at least one releasable lock being in said first state.

20. The modular vapor-tight light fixture as in claim 19, wherein said at least one releasable lock includes a bracket, said handle frictionally engaging said bracket to be releasably retained with said at least one releasable lock being in said first state.

21. The modular vapor-tight light fixture as in claim 13, wherein said at least one releasable lock includes a bracket, said handle interferingly engaging said bracket to be releasably retained with said at least one releasable lock being in said first state.

22. The modular vapor-tight light fixture as in claim 13, wherein said first and third end caps are translucent.

23. The modular vapor-tight light fixture as in claim 13, further comprising at least one mounting bracket having first and second secondary mounting strip portions configured to be simultaneously received respectively in said first and second mounting channels.

24. The modular vapor-tight light fixture as in claim 13, wherein said first and second rails extend continuously between said first and second ends of said first channel housing.

* * * * *